US006240691B1

(12) United States Patent
Holzkaemper et al.

(10) Patent No.: US 6,240,691 B1
(45) Date of Patent: Jun. 5, 2001

(54) PREFABRICATED COMPOSITE BUILDING PANEL WITH FIRE BARRIER

(75) Inventors: Rolf Holzkaemper; Larry Hesterman, both of Regina (CA)

(73) Assignee: Pan-Brick Inc., Saskatchewan (CA)

( * ) Notice: Subject to any disclaimer, the term of this patent is extended or adjusted under 35 U.S.C. 154(b) by 0 days.

(21) Appl. No.: 09/035,542

(22) Filed: Mar. 5, 1998

Related U.S. Application Data

(63) Continuation-in-part of application No. 08/667,310, filed on Jun. 12, 1996, now abandoned.

(51) Int. Cl.[7] ..... E04C 2/288

(52) U.S. Cl. ..... 52/315; 52/309.8; 52/387; 52/389

(58) Field of Search ..... 52/314, 235, 236.3, 52/401.4, 404.2, 419, 421, 424, 428, 439, 526.06, 742.13, 742.1, 747.12, 443, 444, 445, 379, 389, 315, 309.1, 309.3, 309.13, 309.16, 309.17, 309.4, 309.8

(56) References Cited

U.S. PATENT DOCUMENTS

| | | | | |
|---|---|---|---|---|
| 2,151,220 | * | 3/1939 | Mattes | 52/314 |
| 3,621,625 | * | 11/1971 | Medow | 52/314 |
| 3,646,715 | * | 3/1972 | Pope | 52/309.1 |
| 3,715,417 | * | 2/1973 | Pope | 52/314 |
| 3,740,909 | * | 6/1973 | Stinnes | 52/302.1 |
| 3,882,218 | * | 5/1975 | Bixel | 52/742.1 |
| 4,011,702 | * | 3/1977 | Matyas | 52/387 |
| 4,079,554 | * | 3/1978 | Terwilliger | 52/100 |
| 4,140,540 | * | 2/1979 | Caspar | 252/306 |
| 4,407,104 | * | 10/1983 | Francis | 52/309.4 |
| 4,483,122 | * | 11/1984 | Crandell | 52/747.1 |
| 4,557,089 | * | 12/1985 | Breithaupt | 52/235 |
| 4,597,235 | * | 7/1986 | Olsen | 52/509 |
| 4,686,807 | * | 8/1987 | Newsome | 52/314 |
| 4,875,622 | * | 10/1989 | Lents | 52/314 |
| 4,920,716 | * | 5/1990 | Coffey | 52/386 |
| 5,280,689 | * | 1/1994 | Mill | 52/309.9 |
| 5,624,607 | * | 4/1997 | Kanai | 252/606 |
| 5,715,637 | * | 2/1998 | Hesterman et al. | 52/315 |

FOREIGN PATENT DOCUMENTS

| | | | | |
|---|---|---|---|---|
| 465698 | * | 5/1937 | (GB) | 52/314 |

* cited by examiner

*Primary Examiner*—Beth A. Stephan
(74) *Attorney, Agent, or Firm*—Frost Brown Todd LLC

(57) ABSTRACT

A prefabricated composite panel is disclosed of the type comprising a rigid sheet of cellular polymeric material, a covering layer on the outer face of the foam sheet made of a cementitious material and a plurality of rigid facing elements embedded in and to the outer face of the cementitious layer so as to define an outermost surface of the panel, the facing elements being attached to the outer face in a pattern similar to conventional brickwork. Support strips formed from a rigid material different from the cellular polymeric material engage the foam sheet, the cementitious layer and a plurality of the facing elements to provide support of the facing elements to resist downward sagging of the facing elements on the foam sheet, such sagging induced by heat, combustion or other environmental factors. The cementitious layer is a fire barrier, and can be supplemented with additional fire retardant elements. A method of manufacturing such building panel is also disclosed.

20 Claims, 7 Drawing Sheets

PREFABRICATED COMPOSITE BUILDING PANEL WITH FIRE BARRIER

This application is a continuation-in-part of Ser. No. 08,667,310 filed Jun. 12,1996, now abandoned.

BACKGROUND

Some of the earlier prior art in this area includes U.S. Pat. Nos. 3,646,715 and 3,715,417 (Pope) assigned to Dupont of Canada and U.S. Pat. No. 3,740,909 (Stinnes) to the same Assignee.

This invention relates to a prefabricated composite building panel of the type comprising a rigid foam sheet of foamed cellular polymeric material, such as polyurethane or the like, on an outer face of which is attached a plurality of facing elements, such as brick slices, which are partially embedded in and attached to the outer face by the foaming action of the polymeric material. The facing elements are arranged in a pattern with spaces between the facing elements with those spaces being filled by a covering layer on the outer face of the foam sheet which is preferably formed of an aggregate intimately bonded into or integrated with the outer face of the foam sheet by the foaming action of the polymeric material. The basic model of this type of building panel is best outlined in our issued U.S. Pat. No. 5,715,637 to Hesterman et al.

All of these patents relate to a system of manufacturing prefabricated composite panels which has achieved some commercial success. One point which has to some extent limited commercial success is that of a restriction in the fire retardant qualities of the product. The brick facing elements are of course resistant to combustion. The aggregate which is embedded into the outer layer of the polyurethane foam sheet is also resistant to combustion. However the polyurethane foam itself is combustible and hence there is some possibility of the panel as a whole reaching a state of combustion so that the panel breaks down allowing direct access by the flame to the foam which can then bum freely eventually allowing access to the wall structure behind the panel.

Combustion tests have been observed and it has been found that once the aggregate layer filling the spaces between the facing elements has been breached by the combustion, rapid combustion of the polyurethane foam behind the facing elements and the aggregate soon occurs thus causing breakdown of the panel. Thus the panel is resistant to combustion for an initial period of time but once the layer is breached then the breakdown of the panel soon follows.

SUMMARY OF THE INVENTION

It is the object of the present invention to provide a prefabricated composite building panel with greater fire-retardant capabilities than those such panels currently available, and which will allow prefabricated building panels of this type to meet stringent fire safety standards.

It is the further object of the present invention to provide a prefabricated composite building panel with a fireproof barrier, wherein the fire barrier is cementitious in nature.

The invention, a prefabricated composite building panel with a fire barrier, accomplishes its objects comprising substantially a prefabricated composite building panel for attachment to a vertical wall of a building comprising a rigid sheet of cellular polymeric material having an outer face for facing outwardly of the wall and an inner face for facing inwardly of the wall; a set layer of a cementitious material, said cementitious layer being separate from the sheet and being bonded to the outwardly facing face of the sheet; a plurality of rigid facing elements carried on the outer face of the cementitious layer so as to define an outermost surface of the panel, the facing elements being carried in a pattern defining spaces between at least some of the facing elements and adjacent ones of the facing elements; and a plurality of support strips engaging the cementitious layer, the polymeric sheet and the facing elements.

The support strips which have been added are made of metal, and engage and provide support for the facing elements and the cementitious layer.

It has been found that the vertical stability of the panel and the facing elements can be further improved by strengthening the cementitious layer. Fibreglass strands or other conventional strengthening methods might be used.

Yet further an improvement can be obtained by adding gypsum or another fire retardant material to the cementitious material as an intimately mixed composite. The gypsum carries water molecules which, when heated, give off the water as water vapour providing a significant cooling action on the product. This addition of gypsum would assist in maintaining the cementitic us layer in a cooled condition to yet further prevent or inhibit the penetration of the combustion through the cementitious layer to the underlying polyurethane foam sheet.

The strength and thickness of the cementitious layer should be sufficient to provide support for the facing elements in a fire situation. The cementitious layer should fill the spaces between the facing elements to a partial depth, to provide support to the facing elements and yield a conventional brickwork pattern. The cementitious layer also covers a rear surface of the facing elements so as to define a layer portion between the elements and the front face of the sheet. The cementitious layer should be rigid.

The support strips might have many configurations. In one embodiment, the support strip includes an upper hanger portion having a generally horizontal element for engaging a part of the polymeric sheet and a part of the cementitious layer for communicating downward forces from the facing elements into the sheet.

Where the support strip includes a substantially vertical strip, proper support to the facing elements in a fire will be provided. The support strips might also include a plurality of vertical elongate members Lt spaced positions horizontally of the panel. Where the facing elements comprise rectangular bodies arranged in rows with spaces therebetween, the support strips are arranged to engage a plurality of the facing elements.

The support strips could be made of metal, or other materials which would provide the same degree of support as metal in the event of a fire, and can be molded into the cementitious layer and the polymeric sheet.

A support panel can also be added to the back of the polymeric sheet, the support panel being plywood or some other material. The support panel is bonded into place on the rear surface of the sheet via the foaming action of the sheet.

An interlocking effect can be achieved by arranging the rectangular facing elements in rows with spaces therebetween, the pattern being arranged such that at each end of the panel there are a plurality of the facing elements some of which have a portion thereof projecting from and exposed at the end of the sheet, each of said elements having a portion of the sheet behind the element, and support strips embedded within the sheet and/or the layer and extending into the portion of the sheet and/or the layer behind the element. In panels with a support panel, this effect can be accomplished by leaving the projecting elements exposed beyond both ends and the bottom of the sheet.

The panel of the present invention could be manufactured by providing a horizontal, generally planar mold having a plurality of receptacles each for receiving a respective one of a plurality of rigid facing; elements so as to arrange the elements with front faces thereof in a common horizontal plane in a pattern defining spaces between side edges of at least some of the facing elements and side edges of adjacent ones of the facing elements; placing an element in each of the receptacles; applying into the mold a layer of a cementitious material so as to fill in at least a portion of the spaces between the facing elements and thinly cover the rear face of the facing elements and to engage the portions of the support strips which are in contact with the cementitious material, the cementitious material having setting characteristics so as to set to a rigid condition to form a substantially rigid surface exposed in the mold; placing support strips into the mold before the cementitious material sets to its rigid condition; applying a support panel over the mold so as to leave a space between the exposed surface and the support panel; and, after setting of the cementitious material, injecting a cellular polymeric material into the space so as to form a foamed rigid sheet of the material filling the space and so as to bond to the exposed surface of the layer of cementitious material substantially without penetration into the layer and so as to engage the support strips and the support panel.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
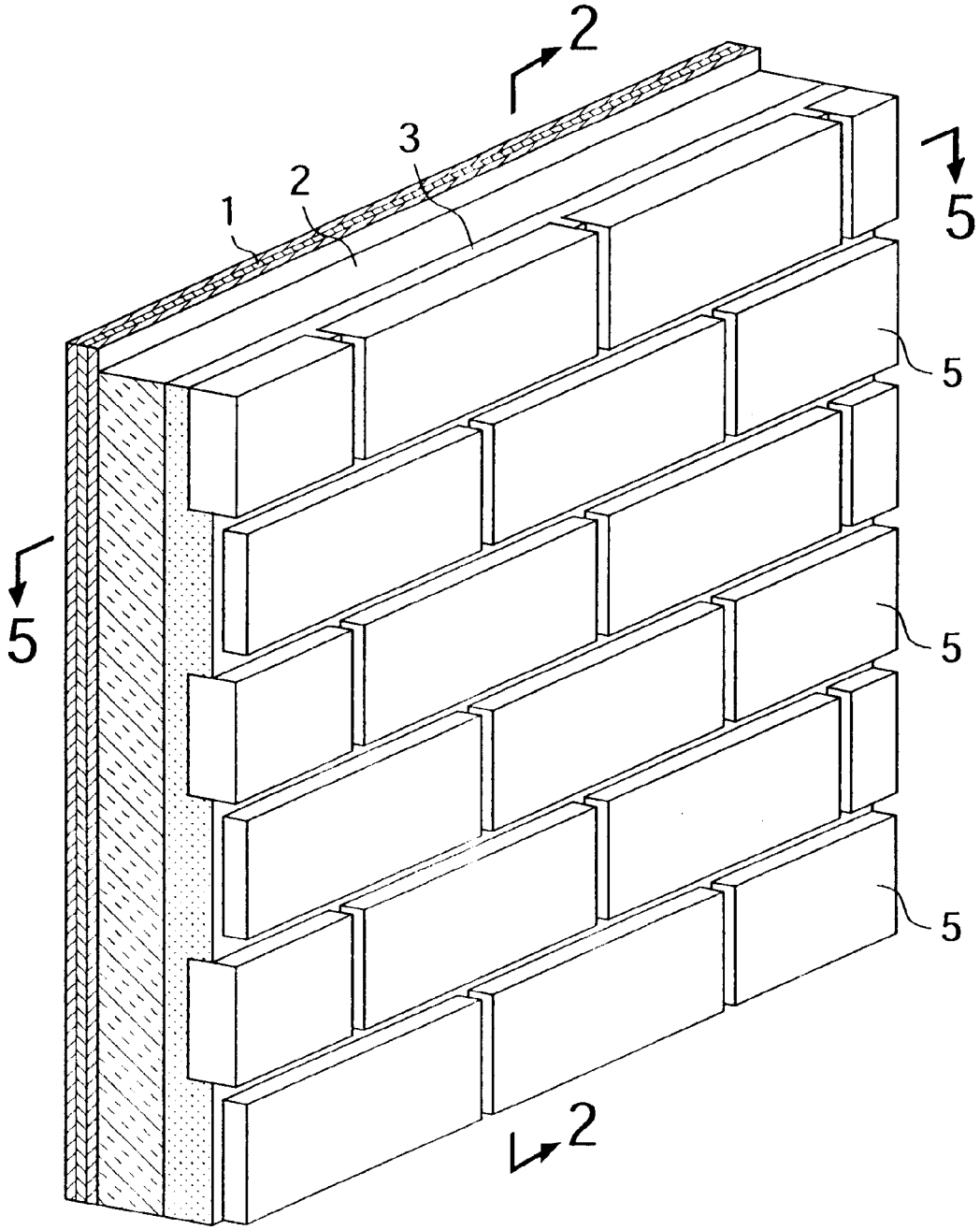
FIG. 1 is a partial isometric view of an embodiment of the panel according to the present invention, from one end.

The panel of the type shown in FIG. 1 is generally described in detail in the above mentioned patents and therefore details of the materials involved, the method of manufacture and the techniques for interconnection of the panels are not described herein as they are well known from the product available on the marketplace and from the above patents.

In general the type of building panel shown includes: a rear support panel 1 of plywood, expanded metal or the like; a main rigid foam sheet 2 of polyurethane foam or similar cellular polymeric material; a cementitious layer of a cementitious material 3; support strips 4; and a plurality of facing elements 5. The support panel 1 is attached to the rear or inner surface 2A of the loam sheet. The support panel 1 is intended to be attached to an outer face of a wall thus facing inwardly of the wall with the wall standing vertically. The building panel contemplated by the invention is intended for exterior cladding although it can be used in other situations.

The foam sheet 2 is rigid in the finished product but is formed by a foaming action in situ within a mold defined in part by the support panel 1 and the cementitious layer 3. The foam sheet has a front face 2B which faces outwardly away from the wall to which the remainder of the panel is attached. The front face 2B of the foam sheet is fully covered by the back face of the cementitious layer 3A.

The facing elements 5 each comprise a brick slice so that the facing elements are rectangular and are laid in a pattern forming the conventional brick pattern readily visible in FIG. 1.

The cementitious layer 3 is attached to the front face 2B of the foam sheet, such attachment taking place during and by way of the foaming of the foam sheet. In this particular embodiment, fibreglass strends 6 have also been added to the cementitious material of the layer 3 in order to increase the strength of the layer 3.

Figure 2:
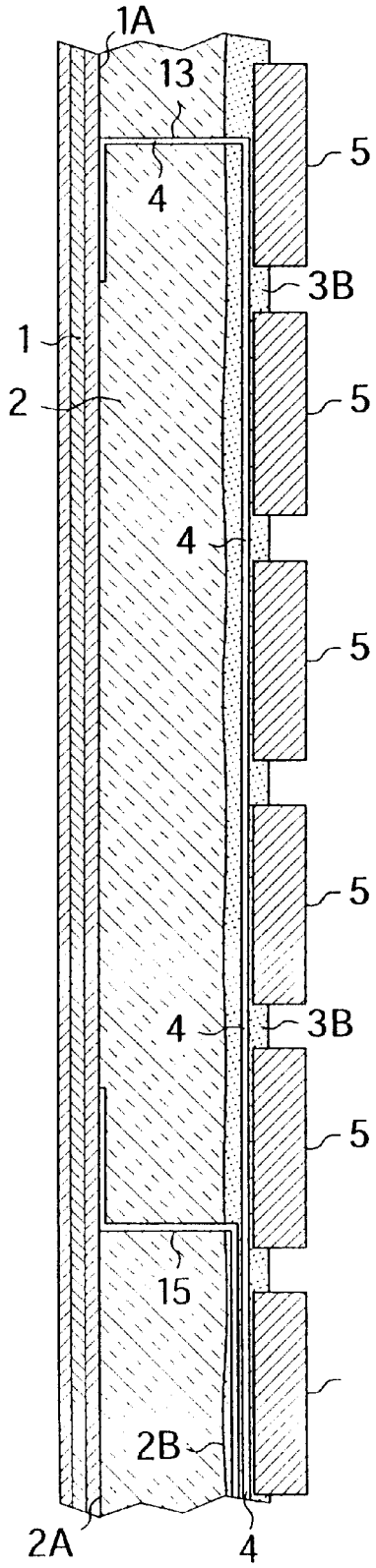
FIG. 2 is a cross sectional view along the lines 2—2 of FIG. 1.
Figure 3:
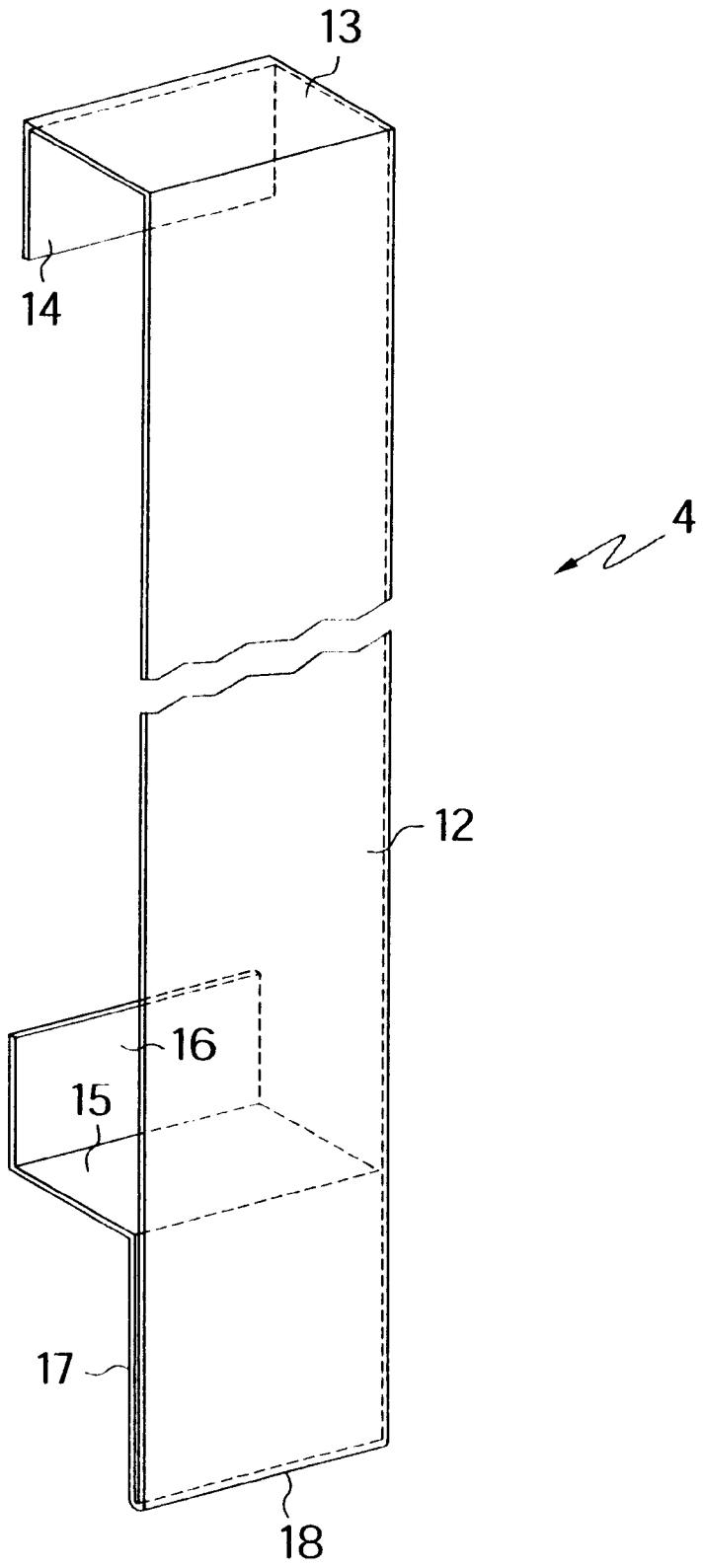
FIG. 3 is an isometric view on an enlarged scale of the support strip of FIGS. 1 and 2.
Figure 4:
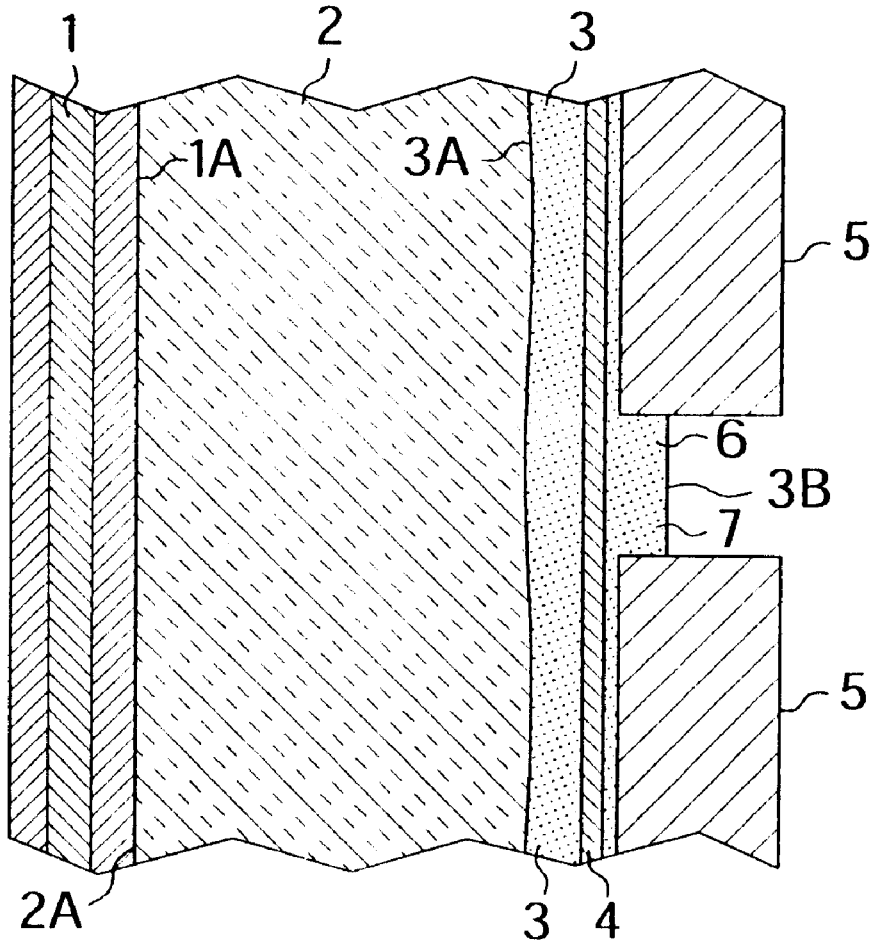
FIG. 4 is a cross sectional view through one portion of the panel on an enlarged scale showing the structure of the cementitious layer.

There are provided support :trips 4 embedded within the foam sheet 2 and the cementitious layer 3 and arranged for supporting the facing elements 5 on the front face 3B of the cernentitious layer—the support strip 4 as shown in cross section in FIG. 2 and in separate isometric view in FIG. 3. The support strip 4 comprises an elongate strip 12 which is arranged in vertical orientation in the finished panel at a position within the cementitious layer immediately rearward of the facing elements 5. The vertical strip 12 has an upper horizontal portion 13 which is turned rearwardly at right angles to the vertical strip 12 and a down turned rearward portion 14 at a rear end of the horizontal portion. The strip further includes a lower horizontal portion 15 and an upturned rear portion 16 lying in a common plane with the rear portion 14. The second horizontal portion 15 is arranged at an upper end of a turned back portion 17. The turned back portion 17 is formed by folding the strip 12 at a lower edge 18 so as to lie directly rearwardly behind the strip 12 generally in contact therewith. This locates the lower horizontal portion 15 at a position spaced from the lower most edge 18 of the strip 12.

The length of the upper and lower horizontal portions 13 and 15 from the strip 12 to the rear portion 14, 16 is equal to the thickness of the layer defined by the rear surface of the facing elements 5 to the front surface of the support panel 1A. Thus as shown in FIG. 2 the support strip 4 is positioned within the building panel so that it engages the rear face of a plurality of the facing elements 5 and the front face of the support panel 1A and the material of the cementitiou3 layer 3 and the foam of the foam sheet 2 are applied around the support strip 4 to hold it in place. The purpose of the support strips is to support the bricks and cement when the polymeric layer is degraded in the heat of a fire, prolonging the time during such fire before the outer face of the panel begins to sag.

Figure 5:
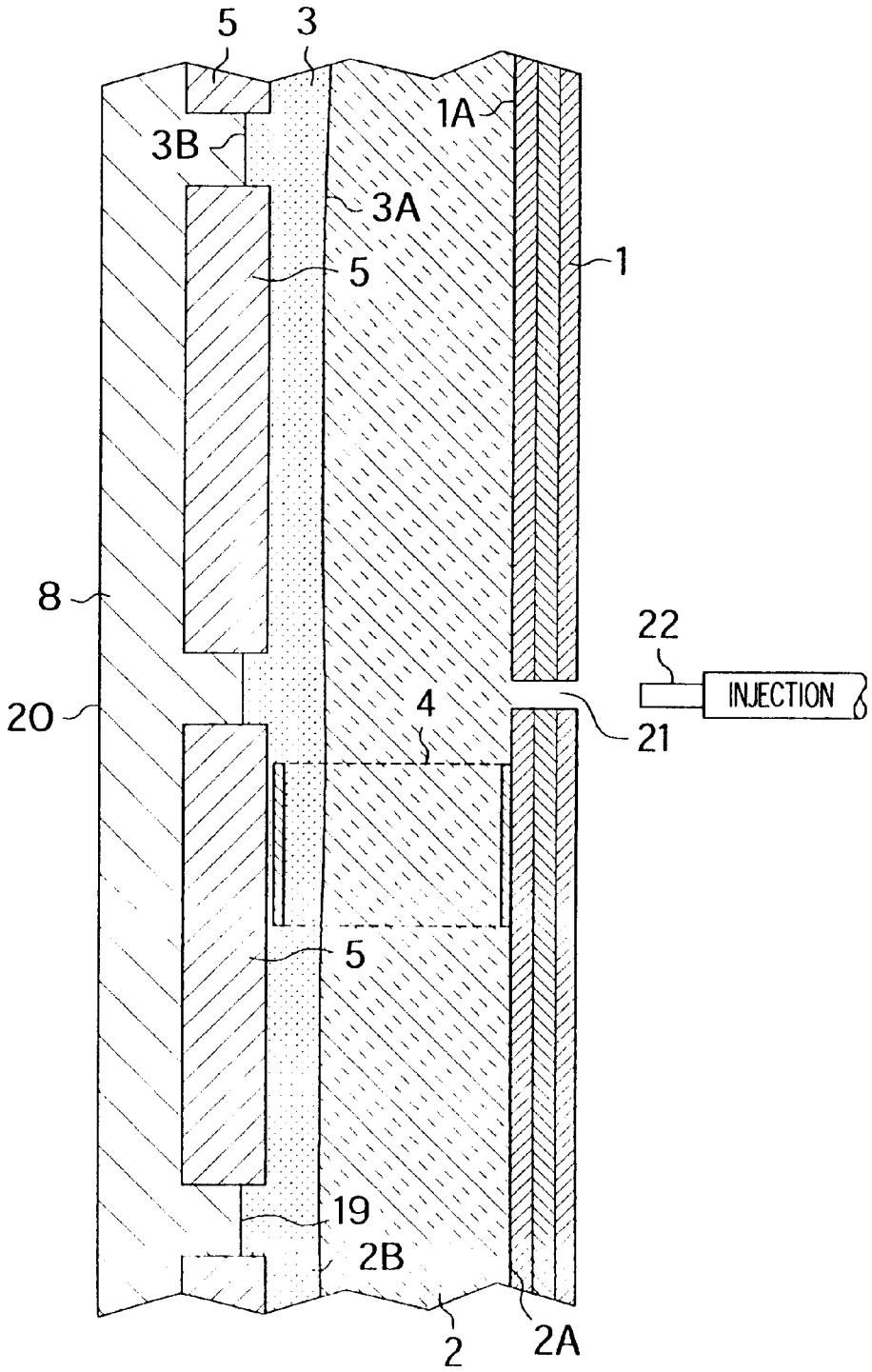
FIG. 5 is a cross-sectional view through one horizontal portion of the manufacturing mold showing the assembly of the panel, along lines 5—5 of FIG. 1.

Referring to FIG. 5, in the manufacture of the panel the facing elements 5 are located within a mold 8 and the cementitious layer 3 is then poured into the mold 8. In FIG.

5, the mold 8 also provides support elements 19 which lift the cementitious layer 3 so that it is spaced away from the front face of the facing elements 5, creating a mortar joint in the finished panel. After the cementitious layer 3 is applied into the mold 8, the support strips 4 are then located in place by pressing them into position in the wet cementitious layer 3 in the mold 8 to the rear and on top of the facing elements, at positions horizontally across the mold. Finally, the support panel 1 is closed into place before the foam sheet 2 is foamed into place. When the support panel 1 is closed into place, it engages the rear portions of the support strips 14 and 16 and thus holds the support strips 4 fixed in place while the foaming occurs.

In a standard 48-inch wide panel it has been found that the provision of three of such support strips at sixteen inch intervals provides sufficient support for all of the facing elements 5 to prevent the above mentioned sagging from occurring and thus prolongs the protection of the foam sheet 2 from the application of combustion. Other numbers and configurations of the support strips could be used in various panel configurations and sizes.

The support strips 4 are formed from metal or other suitable material which is resistant to heat damage, collapse, and environmental factors. For simple and inexpensive manufacture, the strip is preferably manufactured from galvanized sheet metal which can be readily bent to form the structure shown in FIG. 3.

The upper horizontal portion 13 acts as a hanger since it is supported over its full width by the cementitious layer 3 and the foam sheet 2 at a position embedded within the cementitious layer 3 and the foam sheet 2 so that it provides support for the front strip 12.

The horizontal portions 13, 15 are embedded within the foam sheet 2 so as to provide increased strength. As the horizontal portions 13, 15 are engaged across their full width by the cementitious layer 3 and the foam sheet 2, the outer face of the panel is not as prone to sagging when the foam sheet 2 loses its strength on heating in a fire.

A further heat or combustion retardant effect can be provided by an additive into the material forming the cementitious layer. For example, gypsum has been observed to have fire-retardant qualities—gypsum tends to dissipate heat when heat from combustion is applied to the outside face of the panel since gypsum contains water molecules which are released from the molecular structure when the temperature exceeds the boiling point of water. The release of the water molecules therefore in the form of steam extracts heat and releases it from the structure thus maintaining the temperature cooler than would otherwise occur. The addition of gypsum-based material or other fire retardants to the cementitious layer would provide additional fire retardant qualities to the fire barrier of the invention. This is particularly important in the area of the cementitious layer 3 since the layer is relatively thin in comparison with the facing elements 5. It is important in this area to ensure that the temperature is kept as low as possible.

More detail of the method of manufacture is shown in FIG. 5 in which a mold for supporting the facing elements is indicated at 8 and includes a generally horizontal planar backing plate 20 with a plurality of ribs 19 forming an upper surface of the backing plate at positions to locate and space the facing elements 5. The ribs 19 are raised from the horizontal upper surface of the backing plate so as to hold the cementitious layer 3 recessed away from the front face of the facing elements 5 which are arranged horizontally in their initial positions in the mold, as shown in the final manufactured panel in FIG. 1.

In operation of the method, therefore, the mold 8 is filled with the facing elements 5 which are laid in a grid pattern within the recesses defined by the ribs 19. The cementitious layer 3 is then poured into position in the spaces between the facing elements up to a depth thinly covering the rear or upper surface of the facing elements 5. Subsequent to the pouring of the cementitious layer 3, the support strips 4 are pressed into place in the wet cementitious material horizontally along the mold to the rear of the facing elements 5. The support panel 1 is then moved into position and clamped at a predetermined spacing from the rear face of the facing elements 5, engaging the rear portion of the support strips 14 and 16, and the foam polymer riaterial is injected through a hole 21 in the support panel 1 from an injection nozzle 22. The foam then fills the space between the support panel 1 and the rear surface of the cementilious layer 3 and bonds with the cementitious layer 3 to hold the cementitious layer 3, the support strips 4 and the facing elements 5 in place and to the foam sheet 2 and the support panel 1.

Demonstrating the Effect of the Cementitious Fire Barrier

Figure 6:
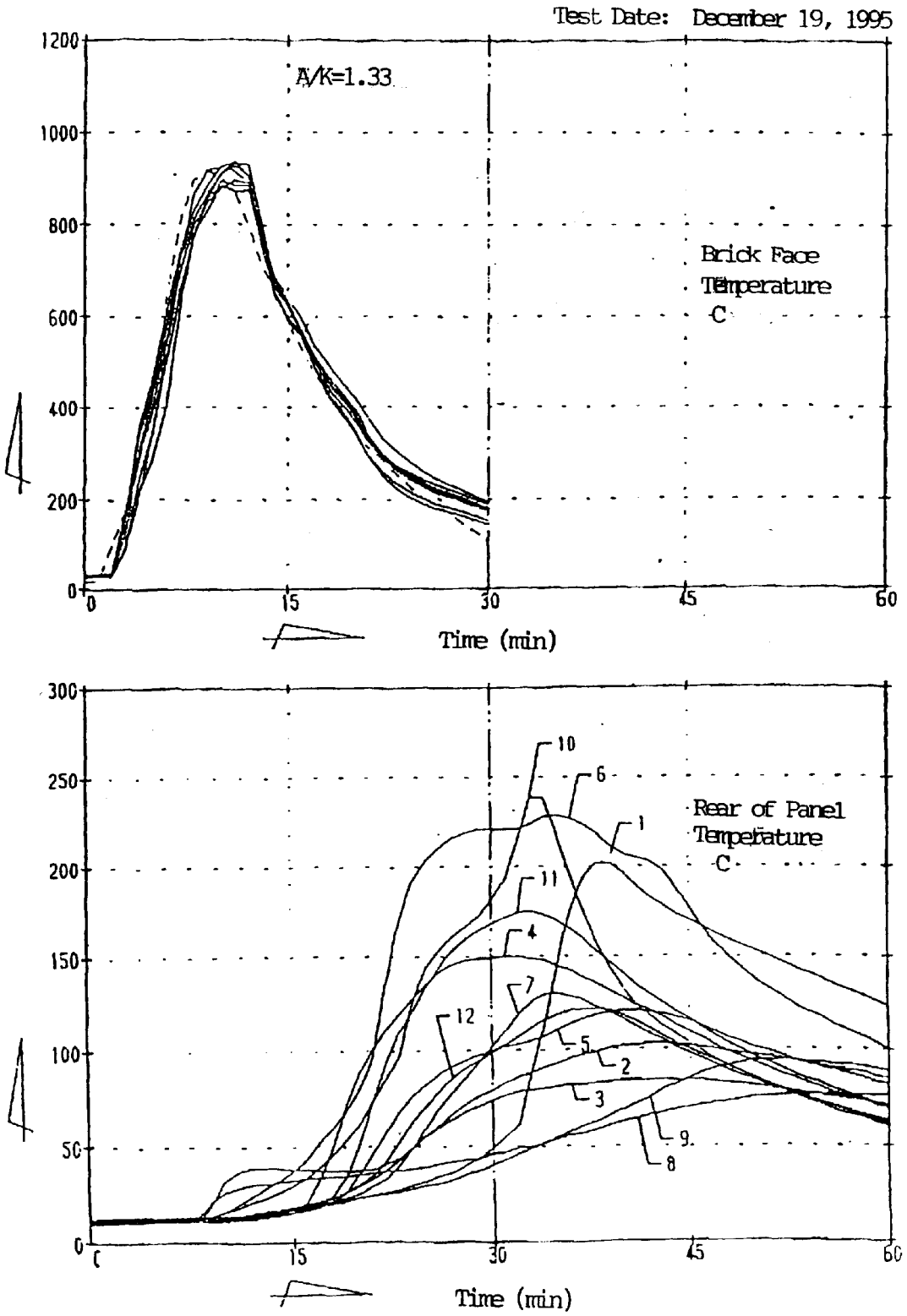
FIG. 6 are temperature curves demonstrating the results of a fire test of the conventional panel without the addition of the cementitious layer.
Figure 7:
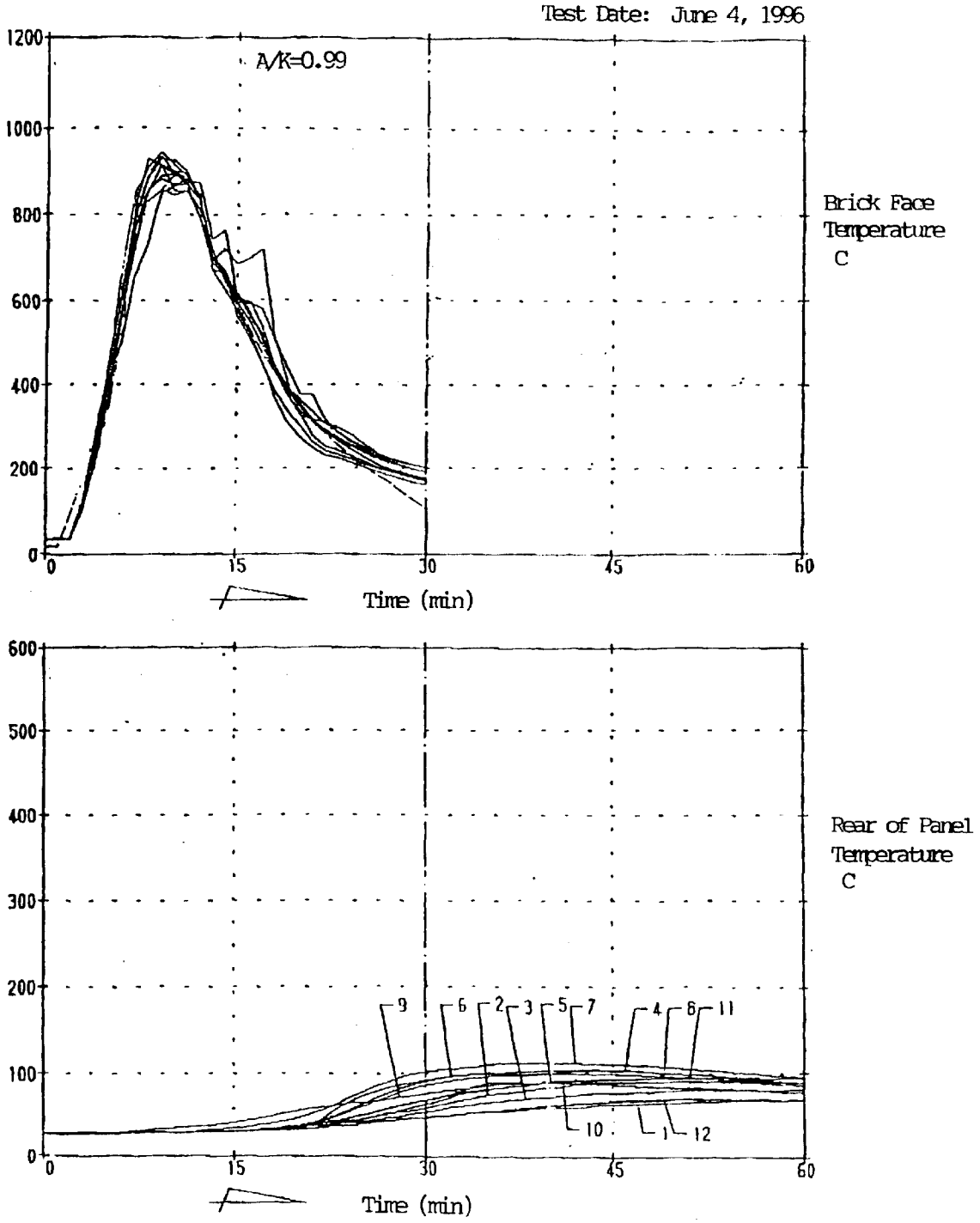
FIG. 7 are temperature curves demonstrating the results of a fire test of the panel according to an embodiment of the present invention.

Fire tests were conducted on our conventional building panel with aggregate mortarjoints held in place by the polyurethane sheet, such as is outlined in U.S. Pat. No. 5,715,637, and on the panel of the present invention, to assess the difference which the addition of the cementitious layer would have on the temperature threshold of the panel of the present invention and the stability of the panel under fire conditions. FIGS. 6 and 7 are graphs showing the temperature of the inside of the panel, i.e. within the polyurethane sheet, over time as heat was applied directly to the face of the panel. The temperature curves of FIG. 6 show the test results for the conventional panel without the addition of the cementitious layer, and FIG. 7 shows the results of a fire test of the panel according to an embodiment of the present invention, with the inclusion of the cementitious layer.

It can be seen that over time the panel of the present invention maintained the lower temperature inside for a longer period of time before it disintegrated. The threshold temperature of the panel of the present invention is higher than that of the conventional panel lacking the cementitious layer.

Thus it can be seen that the invention accomplishes all of its stated objectives. The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

We claim:

1. A prefabricated composite building panel for attachment to a vertical wall of a building, said panel comprising a rigid sheet of cellular polymeric material having an outer face for facing outwards from the wall and an inner face for facing towards the wall; a set layer of cementitious material having an inner face, which is bonded to the outer face of the sheet, and an outer face for facing outwardly of the wall, the cementitious layer being separate from the sheet; a plurality of rigid facing elements carried on the outer face of the cementitious layer so as to define an outermost surface of the panel, the facing elements being carried in a pattern defining spaces between at least some of the facing elements and adjacent ones of the facing elements; and a plurality of support strips engaging the cementitious layer, the sheet and the facing elements.

2. The building panel according to claim 1 wherein the cementitious layer fills the spaces between the facing elements to a partial depth.

3. The building panel according to claim 2 wherein the cementitious layer also covers a rear surface of at least some of the facing elements so as to define a layer between the facing elements and the outer face of the sheet.

4. The building panel according to claim 2 wherein the cementitious layer will support the facing elements in position for a period of time upon melting away of the sheet from behind the cementitious layer.

5. The building panel according to claim 1 wherein the cementitious material of the cementitious layer has setting characteristics so as to set to a rigid condition.

6. The building panel according to claim 1 wherein the cementitious material of the cementitious layer contains a fire-retardant additive.

7. The building panel according to of claim 6 wherein the fire-retardant additive is gypsum.

8. The building panel according to claim 1 wherein each support strip includes an upper hanger portion having a generally horizontal element for engaging part of the sheet and a part of the cementitious layer.

9. The building panel according to claim 1 wherein the mechanical support strips includes a substantially vertical strip.

10. The building panel according to claim 1 wherein the support strip is formed of metal.

11. The panel according to claim 1 wherein the facing elements comprise rectangular bodies arranged in rows with spaces there between and wherein the support strips are arranged to engage a plurality of the facing elements.

12. The building panel according to claim 1 wherein the support strips are molded into the cementitious layer and the polymeric sheet.

13. The building panel according to claim 10 wherein the support strips include a plurality of vertical elongate members at spaced positions horizontally of the panel.

14. The building panel according to claim 1 further comprising a support panel mounted on and bonded to the rear sirface of the sheet.

15. The building panel according to claim 1 wherein the facing elements comprise rectangular bodies arranged in rows with spaces therebetween, the pattern being arranged such that at each end of the panel there are a plurality of the facing elements each of which has a portion thereof projecting from and exposed at the end of the sheet, each of the facing elements having a portion of the sheet behind the element, and support strips embedded within the sheet and/or the layer and extending into the portion of the sheet and/or the layer behind the facing element.

16. The panel according to claim 15 further comprising a rigid support panel bonded onto the inner face of the sheet.

17. A method of manufacturing a building panel comprising:

providing a horizontal, gererally planar mold having a plurality of receptacles each for receiving a respective one of a plurality of rigid facing elements so as to arrange the facing elements with front faces thereof in a common horizontal plane in a pattern defining spaces between side edges of at least some of the facing elements and side edges of adjacent ones of the facing elements;

placing a facing element in each of the receptacles;

applying into the mold a layer of cementitious material so as to fill in at least the spaces between the facing elements and thinly cover the rear face of the facing elements and to engage portions of support strips which are in contact with the cementitious material; the cementitious material having setting characteristics so as to set to a rigid condition to form a substantially rigid surface exposed in the mold;

placing the support strips into the mold before the cementitious layer sets to its rigid condition, the support strips engaging the cementitious material and some of the facing elements;

applying a support panel over the mold so as to leave a space between the exposed surface of the cementitious layer and the support panel; and after setting of the cementitious layer, injecting a cellular polymeric material into the space between the exposed surface of the cementitious layer and the support panel to form a foamed rigid sheet of the polymeric material filling the space, the sheet bonding to the exposed surface of the cementitious layer substantially without penetration into the cementitious layer, the sheet also engaging the support strips and the support panel.

18. A method of manufacturing a building panel comprising:

providing a horizontal, generally planar mold having a plurality of receptacles each for receiving a respective one of a plurality of rigid facing elements so as to arrange the facing elements with front faces thereof in a common horizontal plane in a pattem defining spaces between side edges of at least some of the facing elements and side edges of adjacent ones of the facing elements;

placing a facing element in each of the receptacles;

applying into the mold a layer of a cementitious material so as to fill in at least the spaces between the facing elements and thinly cover the rear face of the facing elements, the cementitious material having setting characteristics so as to set to a rigid condition to form a substantially rigid surface exposed in the mold;

placing support strips into the mold before the cementitious layer sets to its rigid condition, the support strips engaging the cementitious material and some of the facing elements;

applying a support panel over the mold so as to leave a space between the exposed surface of the cementitious layer and the support panel; and after setting of the cementitious layer, injecting a cellular polymeric material into the space between the exposed surface of the cementitious layer and the support panel to form a foamed rigid sheet of the polymeric material filling the space, the sheet bonding to the exposed surface of the cementitious layer substantially without penetration into the cementitious layer, the sheet also engaging the support strips and the support panel;

wherein the cementitious layer also covers the rear surface of at least some of the facing elements, so as to define a layer portion between the facing elements and the front face of the sheet.

19. A method of manufacturing a building panel comprising:

providing a horizontal, generally planar mold having a plurality of receptacles each for receiving a respective one of a plurality of rigid facing elements so as to arrange the facing elements with front faces thereof in a common horizontal plane in a pattern defining spaces between side edges of at least some of the facing elements and side edges of adjacent ones of the facing elements;

placing a facing element in each of the receptacles;

applying into the mold a layer of a cementitious material so as to fill in at least the spaces between the facing elements and thinly cover the rear face of the facing elements, the cementitious material having setting characteristics so as to set to a rigid condition to form a substantially rigid surface exposed in the mold;

and wherein the cementitious layer contains a fire-retardant additive;

placing support strips into the mold before the cementitious layer sets to its rigid condition, the support strips engaging the cementitious material and some of the facing elements;

applying a support panel over the mold so as to leave a space between the exposed surface of the cementitious layer and the support panel; and after setting of the cementitious layer, injecting a cellular polymeric material into the space between the exposed surface of the cementitious layer and the support panel to form a foamed rigid sheet of the polymeric material filling the space, the sheet bonding to the exposed surface of the cementitious layer substantially without penetration into the cementitious layer, the sheet also engaging the support strips and the support panel.

20. A method of manufacturing a building panel comprising:

providing a horizontal, generally planar mold having a plurality of receptacles each for receiving a respective one of a plurality of rigid facing elements so as to arrange the facing elements with front faces thereof in a common horizontal plane in a pattern defining spaces between side edges of at least some of the facing elements and side edges of adjacent ones of the facing elements;

placing a facing element in each of the receptacles;

applying into the mold a layer of a cementitious material so as to fill in at least the spaces between the facing elements and thinly cover the rear face of the facing elements, the cementitious material having setting characteristics so as to set to a rigid condition to form a substantially rigid surface exposed in the mold;

placing support strips into the mold before the cementitious layer sets to its rigid condition, the support strips engaging the cementitious material and some of the facing elements;

applying a support panel over the mold so as to leave a space between the exposed surface of the cementitious layer and the support panel; and after setting of the cementitious layer, injecting a cellular polymeric material into the space between the exposed surface of the cementitious layer and the support panel to form a foamed rigid sheet of the polymeric material filling the space, the sheet bonding to the exposed surface of the cementitious layer substantially without penetration into the cementitious layer, the sheet also engaging the support strips and the support panel; and mounting and bonding a support panel to the rear surface of the sheet.

* * * * *

UNITED STATES PATENT AND TRADEMARK OFFICE

CERTIFICATE OF CORRECTION

PATENT NO. : 6,240,691 B1 
DATED : June 5, 2001
INVENTOR(S) : Rolf C. Holzkaemper and Larry C. Hesterman It is certified that error appears in the above-identified patent and that said Letters Patent is hereby corrected as shown below:

Column 2,
Line 46, “Lt” should read -- at --.

Column 3,
Line 8, “;” should be deleted.

Column 4,
Line 26, “strends” should read -- strands --.
Line 29, “:trips” should read -- strips --.
Line 57, “cementitiou3” should read -- cementitious --.

Column 6,
Line 12, “riaterial” should read -- material --.
Line 15, “cementilious” should read -- cementitious --.

Column 7,
Line 17, “of” should be deleted.
Line 41, “sirface” should read -- surface --.
Line 55, “gererally” should read -- generally --.

Signed and Sealed this

Thirtieth Day of March, 2004

JON W. DUDAS
*Acting Director of the United States Patent and Trademark Office*